US005556362A

United States Patent [19]

Whipps

[11] Patent Number: 5,556,362

[45] Date of Patent: Sep. 17, 1996

[54] AUTOMATIC WEIGHT STACK PIN SELECTOR

[76] Inventor: Allen M. Whipps, 5134 Pine Meadow Dr., Grandville, Mich. 49418

[21] Appl. No.: 407,065

[22] Filed: Mar. 20, 1995

[51] Int. Cl.[6] ..... A63B 21/062

[52] U.S. Cl. ..... 482/98; 482/97

[58] Field of Search ..... 482/93, 94, 97, 482/98, 99, 101, 102, 103, 107, 148, 100, 908

[56] References Cited

U.S. PATENT DOCUMENTS

| | | | |
|---|---|---|---|
| 772,906 | 10/1904 | Reach . | |
| 4,627,615 | 12/1986 | Nurkowski . | |
| 4,746,113 | 5/1988 | Kissel . | |
| 4,817,943 | 4/1989 | Pipasik | 482/97 |
| 4,971,305 | 11/1990 | Rennex . | |
| 5,256,121 | 10/1993 | Brotman . | |
| 5,306,221 | 4/1994 | Itaru | 482/97 |
| 5,350,344 | 9/1994 | Kissel . | |

*Primary Examiner*—Stephen R. Crow
*Attorney, Agent, or Firm*—Richard C. Litman

[57] ABSTRACT

A self-releasing pin for a weight training machine of the type having a vertical stack of weights. The self-releasing pin automatically releases a selected number of weights from engagement with a lifting bar when the selected number of weights is returned to a resting position. The main components of the self-releasing pin include a shaft, a bracket, a retaining member, and biasing means. The shaft is capable of reciprocating movement with respect to the bracket through an opening in the bracket. The retaining member is pivotally attached to either the bracket or the shaft to prevent reciprocating movement of the shaft with respect to the bracket. The biasing means are provided intermediate the second end of the shaft and the bracket and bias the shaft to a retracted position.

17 Claims, 4 Drawing Sheets

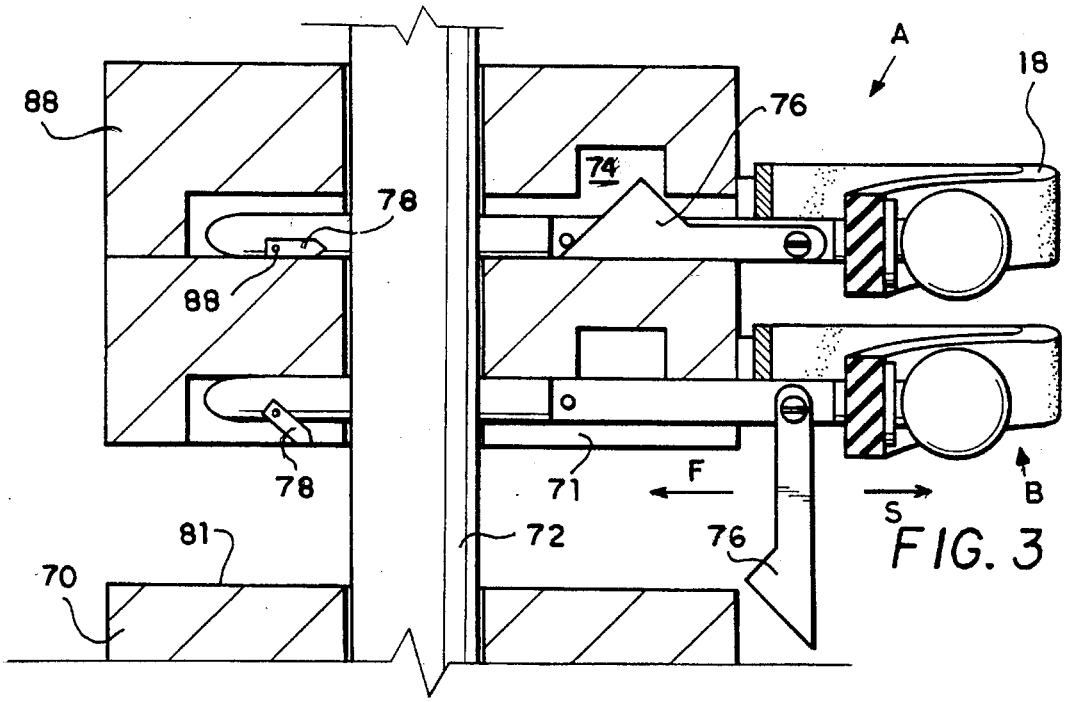
FIG. 3
FIG. 4
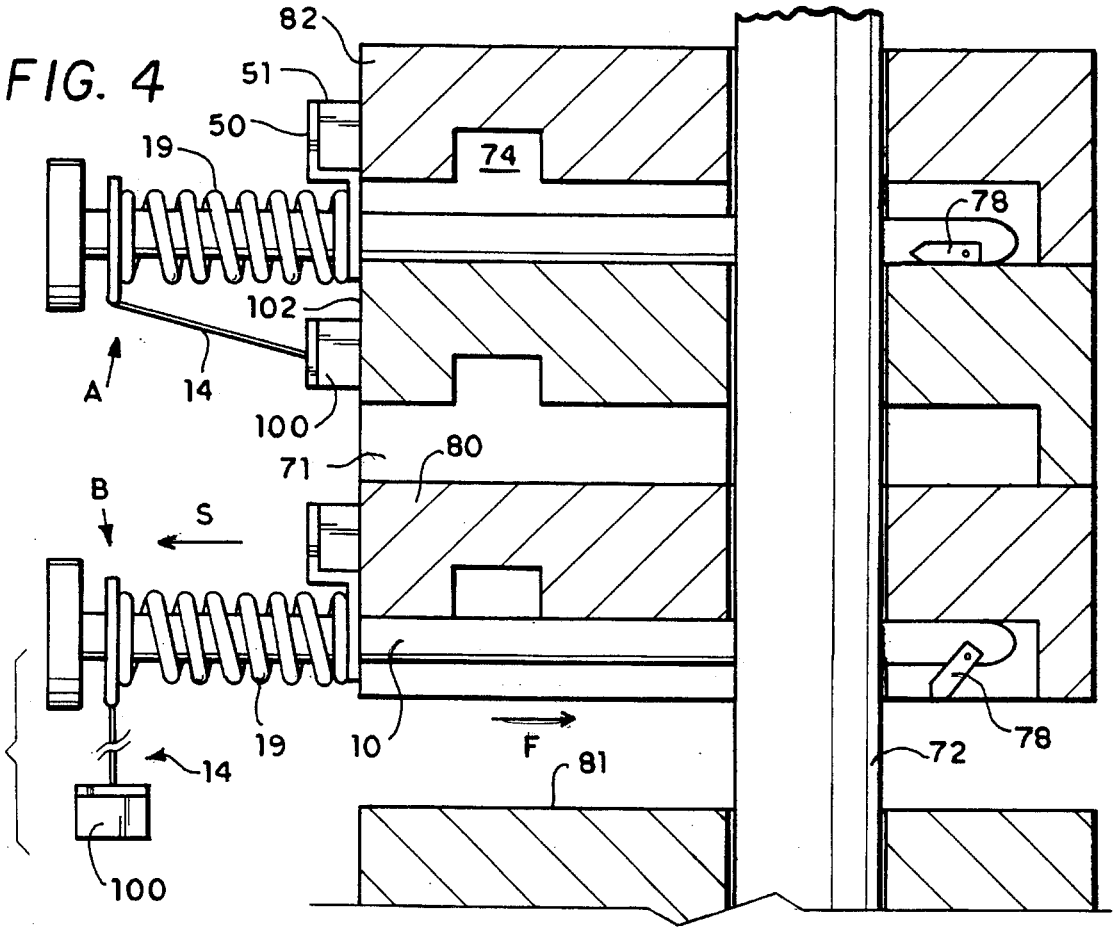

AUTOMATIC WEIGHT STACK PIN SELECTOR

BACKGROUND OF THE INVENTION

1. Field of the Invention

The present invention relates to weight training and weight training machines of the type having a vertical stack of weights.

2. Description of the Prior Art

In our increasingly health conscious society, weight lifting remains one of the most popular methods of increasing muscle strength and muscle tone. Weight lifting is no longer the sole province of the body builder or serious athlete—many Americans now incorporate some form of weight lifting exercises into their workouts. As a result, weight training machines, such as those using a vertical stack of weights, have become increasingly popular because of their ease of use and ability to isolate specific muscle groups during an exercise.

The goal of weight lifting is to fatigue a particular muscle group through a selected weight lifting exercise thereby stimulating muscle growth within the muscle group. To achieve the maximum benefit from weight lifting exercises, the weight lifter completes multiple sets of repetitions for each weight lifting exercise in order to completely fatigue the muscle group being exercised. The weight lifter is required to continuously change the amount of weight being used between sets to insure completion of the set, while also maintaining maximum muscle exertion during a set. As a result, weight lifters are required to spend considerable time in the gym to achieve the maximum workout. For this reason, there is a need for a weight training device that allows the user to achieve the maximum exertion for each repetition of each exercise, thus minimizing the exercise time the user needs to devote to stimulating new muscle growth.

Add-on weights or auxiliary weights which may be added to the weight stacks of weight training machines to incrementally increase the amount of weight available to the user are known in the prior art. U.S. Pat. No. 772,906, issued to Robert Reach on Oct. 18, 1904, shows a weight for use in a weight lifting machine having a recess in one face and a projection on the opposite face. Sliding bolts are attached to the weight and are adapted to engage the projection of an adjacent weight to permit connection of adjacent weights. U.S. Pat. No. 4,971,305, issued to Brian G. Rennex on Nov. 20, 1990, shows a variable add-on weight device which enables weight trainers to select a particular weight and to make this weight selection with smaller weight increments. The device includes a stack of weight pieces or units which stick together and can be separated into multiple parts. U.S. Pat. No. 5,256,121, issued to Eric Brotman on Oct. 26, 1993, shows an auxiliary weight system for use with free weights or weight training machines. The auxiliary weights are formed with small weight values and may be magnetically secured to the main weights to change the aggregate value being lifted by small amounts. None of the above referenced patents teach or suggest a self-releasing pin for a weight training machine.

U.S. Pat. No. 4,627,615, issued to Paul S. Nurkowski on Dec. 9, 1986, shows a progressive weight resistance weight lifting mechanism having a base, a plurality of spaced vertical guide members, a carriage vertically reciprocating along the guide members and a plurality of weight stacks supported by the base. An apertured selector post is slidably disposed through each stack and has a first pin for attaching a selected subset of weights from the stack for upward movement. A second pin on each selector post is provided for locking a slidable collar at selected positions on the post above the carriage. The collars may thus be set at different distances above the carriage. The upward-travelling carriage engages each collar in sequence to serially lift the associated weight stacks. The user thereby experiences progressively increasing weight resistance during the course of a single repetition. Nurkowski does not teach or suggest a self-releasing pin for a weight training machine.

U.S. Pat. No. 4,746,113, issued to Robert M. Kissel on May 24, 1988, shows an automatically adjustable weight changing system including a body carrying a plurality of pins for engagement with the openings of a weight stack. Upon receipt of a signal representative of momentary muscle failure of the user, solenoid operated pin controllers retract the pin supporting the stack of weights being lifted and insert a higher pin in the weight stack to automatically decrease the weights being lifted. U.S. Pat. No. 5,350,344, issued to Robert M. Kissel on Sept. 27, 1994, shows the automatically adjustable weight changing system described in Kissel '113, however, a two-position or double action actuator or solenoid is provided. Kissel '113 and Kissel '344 do not teach or suggest a self-releasing pin for a weight training machine having a retaining member pivotally attached to the shaft of the self-releasing pin.

None of the above inventions and patents, taken either singly or in combination, is seen to describe the instant invention as claimed.

SUMMARY OF THE INVENTION

The present invention is directed to a self-releasing pin for a weight training machine of the type having a vertical stack of weights. The main components of the self-releasing pin include a shaft, a bracket, a retaining member, and biasing means.

The shaft includes a first and a second end. The bracket includes an opening, through which the shaft passes, and a first and a second face. The first face of the bracket is approximate the first end of the shaft. The shaft is capable of reciprocating movement with respect to the bracket through the opening in the bracket. The retaining member is pivotally attached to either the bracket or the shaft to prevent movement of the shaft through the opening in the bracket.

The biasing means are provided intermediate the second end of the shaft and the bracket. The biasing means are fixed to the second face of the bracket and to the shaft proximate to the second end of the shaft. The self-releasing pin automatically releases a selected number of the vertical stack of weights from engagement with a lifting bar when the selected number of the vertical stack of weights is returned to a resting position.

In alternative embodiments of the invention, the biasing means is a spring or a U-shaped rubber spring. In addition, a bulbous handle, suitable for grasping by a user, may be provided at the second end of the shaft.

Accordingly, it is a principal object of the invention to provide a self-releasing pin for a weight training machine of the type having a vertical stack of weights.

It is another object of the invention to provide a self-releasing pin which may be used with all weight training machines using weights having a channel formed therein for receipt of a pin.

It is a further object of the invention to provide a self-releasing spring for a weight training machine which allows the user to reduce the selected weight without having to stop exercising.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a side elevational, environmental view, in cross section, of the first embodiment of the invention shown in FIG. 1, showing a plurality of the self-releasing pins of the present invention sequentially reducing of the number of plates being lifted.

FIG. 4 is a side elevational, environmental view, in cross section, of a second embodiment of the present invention, showing a plurality of the self-releasing pins of the present invention sequentially reducing of the number of plates being lifted.

Similar reference characters denote corresponding features consistently throughout the attached drawings.

DETAILED DESCRIPTION OF THE PREFERRED EMBODIMENTS

Figure 1:
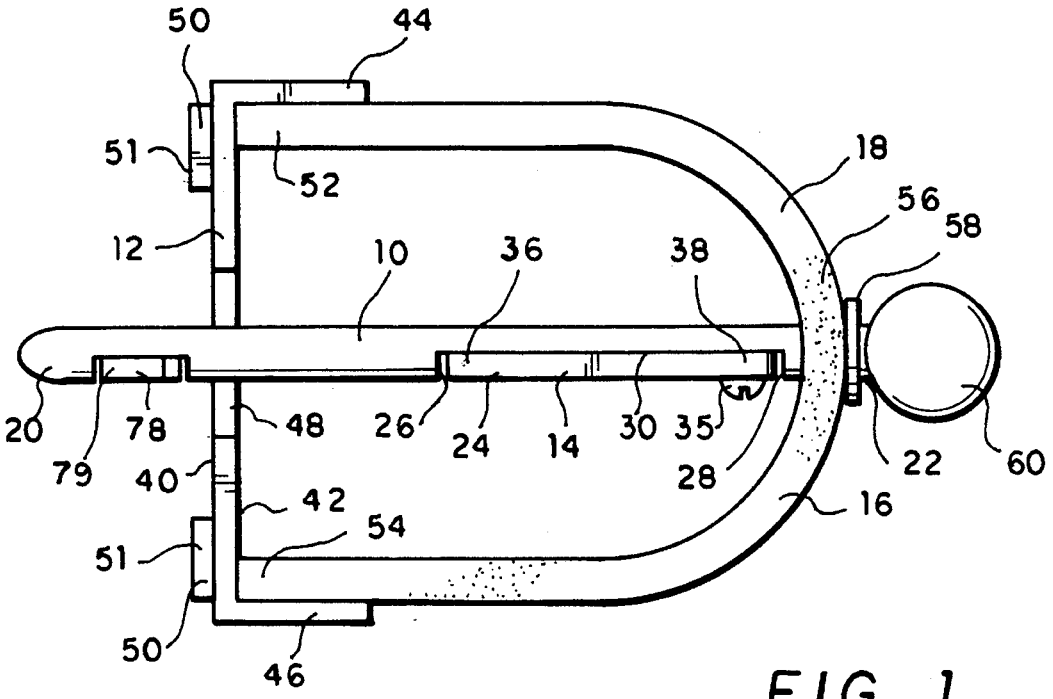
FIG. 1 is a bottom view of a first embodiment of the present invention, showing the biasing means as a U-shaped rubber band and showing the shaft of the self-releasing pin in the retracted position.
Figure 2:
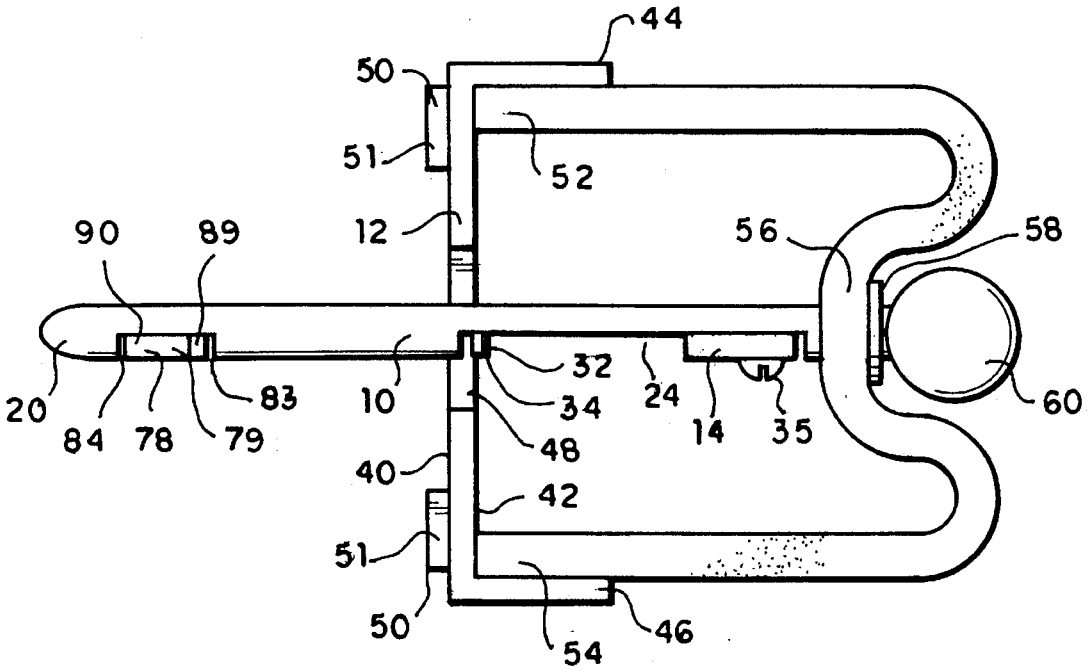
FIG. 2 is a bottom view of the first embodiment of the invention shown in FIG. 1, showing the shaft of the self-releasing pin in the extended position.

A first preferred embodiment of a self-releasing pin for a weight training machine of the type having a vertical stack of weights is shown in FIGS. 1 and 2. The main components of the self-releasing pin include a shaft 10, a bracket 12, a retaining member 14, and biasing means 16.

Referring to FIGS. 1 and 2, biasing means 16 is a U-shaped rubber spring 18. Alternatively, biasing means 16 may be a coil spring 19 as shown in FIGS. 4–9. Shaft 10 is in the form of a narrow, elongated cylinder having a first end 20 and a second end 22. First end 20 can be any shape, but is preferably rounded or blunt to avoid possibility of injury. A rectangular depression 24, having a first side edge 26, a second side edge 28, and a rear edge 30, is formed in shaft 10 for receipt of retaining member 14. A cylindrical stop 32, having a top surface 34, is positioned within rectangular depression 24, proximate first side edge 26, and radially extends from rear edge 30. Cylindrical stop 32 may be of any length, but preferably does not extend beyond the surface of cylindrical shaft 10. A first hole (not shown) is formed in rectangular depression 24 proximate second side edge 28 for receipt of a pivot pin 35. Retaining member 14 includes a first end 36 and a second end 38 having a second hole (not shown) formed therein. Pivot pin 35 passes through the second hole to engage the first hole such that retaining member 14 pivots about pivot pin 35 between an engaged position, parallel to the longitudinal axis of shaft 10, and a released position, perpendicular to the longitudinal axis of shaft 10. Cylindrical stop 32 prevents retaining member 14 from being raised above the engaged position. FIG. 1 shows retaining member 14 in the engaged position and FIG. 2 shows retaining member 14 in the released position.

Continuing to refer to FIGS. 1 and 2, bracket 12, having a first face 40 and a second face 42, is shaped in the form of a rectangle. A first extension 44 and a second extension 46 extend perpendicularly from second face 42. An aperture 48 is formed in bracket 12 to allow shaft 10 to pass therethrough. Shaft 10 is capable of reciprocating movement, between an inserted position and a retracted position, through aperture 48. FIG. 1 shows shaft 10 in the retracted position and FIG. 2 shows shaft 10 in the inserted position. Supplemental attachment means 50, in the form of a pair of magnets 51, are affixed to first face 40.

U-shaped rubber spring 18 includes a first end 52, second end 54, and a curved center portion 56. First end 52 and second end 54 are attached to the interior surfaces of first extension 44 and second extension 46, respectively. Center portion 56 contacts a circular collar 58 which is positioned around shaft 10 proximate second end 22. U-shaped rubber spring 18 biases shaft 10 to the retracted position. A bulbous handle 60, suitable for grasping by the hand of a user, is positioned at second end 22 of shaft 10.

FIG. 3 shows two self-releasing pins, A and B, of the first preferred embodiment, each pin being shown inserted into a vertical weight stack 70 used in the typical weight training machine. Each weight of weight stack 70 includes a channel 71 formed therein which communicates with a corresponding opening (not shown) in a lifting bar 72. A pin, such as self-releasing pins A and B, is inserted into channel 71 to removably secure the weight to lifting bar 72. Channel 71 includes a notch 74. Retaining member 14 includes a triangular extension 76, positioned at second end 38, for engaging notch 74 when shaft 10 is in the inserted position. Self-releasing pin A shows retaining member 14 in the engaged position and self-releasing pin B shows retaining member 14 in the released position.

A second rectangular depression 79, having a first side edge 83, a second side edge 84, and a rear edge 85, is formed in shaft 10 for receipt of a safety latch 78. A third hole (not shown) is formed in second rectangular depression 79 proximate second side edge 84 for receipt of a pivot pin 88. Safety latch 78 includes a first end 89 and a second end 90 having a fourth hole (not shown) formed therein. Second pivot pin 88 passes through the fourth hole to engage the third hole such that safety latch 78 pivots about second pivot pin 88 between an engaged position, parallel to the longitudinal axis of shaft 10, and a released position, perpendicular to the longitudinal axis of shaft 10. First end 89 is tapered to a point to allow smooth entry of safety latch 78 into channel 71. Self-releasing pin A shows safety latch 78 in the engaged position and self-releasing pin B shows safety latch 78 in the released position.

In operation, the self-releasing pin is inserted into a selected weight 80 of weight stack 70 by the weight lifter. When inserted, the weight lifter holds retaining member 14 and safety latch 78 in the engaged positions to allow passage of shaft 10 through channel 71. U-shaped rubber spring 18 is compressed between bracket 12 and circular collar 58 thereby placing a spring force, indicated by arrow S, on shaft 10. Shaft 10 is pushed through channel 71 until reaching the inserted position. In the inserted position, when shaft 10 extends through lifting bar 72 and triangular extension 76 engages notch 74 to hold shaft 10 in the inserted position. Prior to lifting selected weight 80, retaining member 14 and safety latch 78 are held in the engaged position by a top surface 81 of weight stack 70. A second pin is inserted above the first inserted self-releasing pin at a second, reduced weight 82.

When ready to exercise, the weight lifter lifts lifting bar 72 thus raising selected weight 80, as shown in FIG. 3 by self-releasing pin B. Once lifted, retaining member 14 and safety latch 78 are free to fall to the released positions. Shaft 10 is held in the inserted position by a friction force, indicated by arrow F, generated by the surface contact between selected weight 80 and shaft 10. Spring force S is insufficient to overcome friction force F. At a minimum, spring force S should be less than the friction force generated by one weight plate on the self-releasing pin. Safety latch 78, while in the released position, insures that shaft 10 will not return to the retracted position if friction force F should drop below spring force S, as may occur when the selected weight reaches the top of the exercise motion.

Once the weight lifter tires of selected weight 80, he or she can reduce selected weight 80 to second weight 82. This is accomplished by momentarily resting selected weight 80 on weight stack 70. When selected weight 80 is in the resting position, friction force F is reduced, allowing U-shaped rubber spring 18 to force shaft 10 to the retracted position. Safety latch 78 contacts weight stack 70 and returns to the engaged position allowing passage of shaft 10 through channel 71. Supplemental attachment means 50 holds bracket 12 and shaft 10 in contact with selected weight 80 once shaft 10 is returned to the retracted position. Alternatively, supplemental attachment means 50 may be removed to allow the self-releasing pin to fall to the floor when shaft 10 is returned to the retracted position.

It should be realized from the above description of the operation of the self-releasing pin of the present invention that a series of such self-releasing pins may be used by the weight lifter thus allowing the weight lifter to decrease the selected weight numerous times during one set without having to interrupt exercising.

Referring to FIG. 4, a second preferred embodiment of the self-releasing pin of the present invention is shown. Biasing means 16 includes coil spring 19 fixed at one end to circular collar 58 and at the other end to second face 42. Retaining member 14 includes a magnet 100 affixed to second end 38. First end 36 is pivotally attached by any well known means to circular collar 58, such as, having a slot cut into collar 36 to engage a circular loop fastener connected to first end 36.

The second preferred embodiment operates in substantially the same manner as described above. When shaft 10 is pushed into the inserted position, magnet 100 is removably attached to a front face 102 of the weight below selected weight 80, thereby preventing spring 98 from returning shaft 10 to the retracted position. Once the weight is lifted, magnet 100 detaches from front face 102 and retaining member 14 falls to the released position. The weight lifter may decrease the selected weight in the same manner described above.

Figure 5:
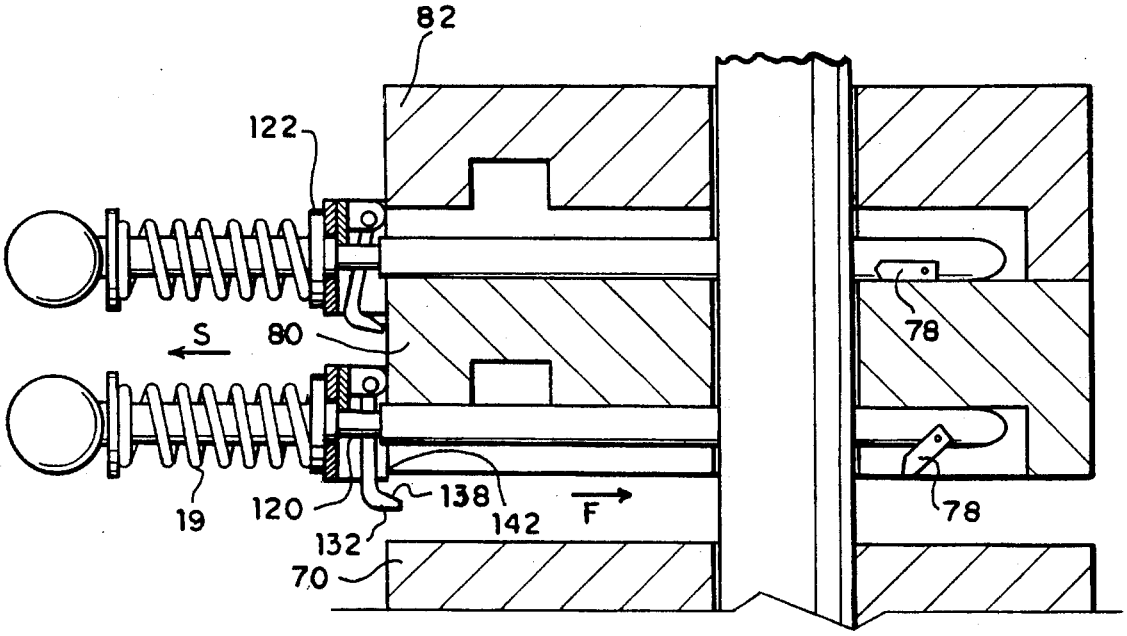
FIG. 5 is a side elevational, environmental view, in cross section, of a third embodiment of the present invention, showing a plurality of the self-releasing pins of the present invention sequential reducing of the number of plates being lifted.
Figure 6:
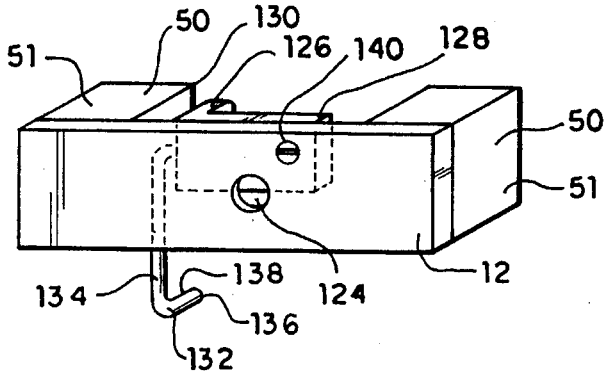
FIG. 6 is a perspective view of the bracket and retaining member of the third embodiment of the invention shown in FIG. 5.
Figure 7:
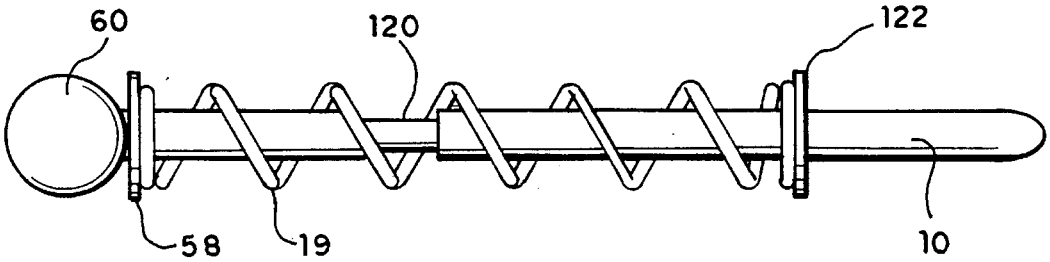
FIG. 7 is a side elevational view of the shaft and biasing means of the third embodiment of the invention shown in FIG. 5.

Referring to FIGS. 5–7, a third preferred embodiment of the self-releasing pin of the present invention is shown. Shaft 10 includes a notch 120 formed by a reduced diameter portion of shaft 10. A second circular collar 122 is mounted on shaft 10 to engage an end of coil spring 19. Bracket 12 includes a centrally located circular aperture 124. Retaining member 14 includes a latch 126, having a first end 128 and a second end 130, and an L-shaped unlocking member 132, having an elongated portion 134 and a base portion 136. Base portion 136 includes an angled top surface 138. Second end 130 extends perpendicularly from first end 128. L-shaped unlocking member 132 is pivotally attached by any well known attaching means to second end 130. A fifth hole (not shown) in bracket 12 is aligned to communicate with a sixth hole (not shown) in latch 126 proximate first end 128. A third pivot pin 138 passes through the first and second holes. Latch 126 pivots about third pivot pin 140 between an unlocked position, allowing shaft 10 to move through circular aperture 124, and a locked position, engaging notch 120 and prohibiting shaft 10 to move through circular aperture 124.

The third preferred embodiment of the self-releasing pin operates in substantially the same manner as described above. The weight lifter holds latch 126 in the unlocked position while pushing shaft 10 through circular aperture 124 and into the inserted position. In the inserted position, latch 126 falls into the locked position, engaging notch 120 and prohibiting shaft 10 from moving through circular aperture 124. L-shaped unlocking member 132 is wedged between front face 102 and first face 40. As selected weight 80 is lifted by the weight lifter, L-shaped unlocking member 132 is free to extend perpendicularly from second end 128. When the weight lifter tires and wishes to reduce selected weight 80, he or she momentarily rests selected weight 80 on weight stack 70. As selected weight 80 is lowered, L-shaped unlocking member 132 contacts weight stack 70 and is forced upwards thereby raising latch 126 to the unlocked position allowing shaft 10 to return to the retracted position. Angled top surface 138 engages a corner 142 of selected weight 80 in a camming action, forcing L-shaped unlocking member 132 away from selected weight 80 and preventing it from being trapped between selected weight 80 and weight stack 70.

Figure 8:
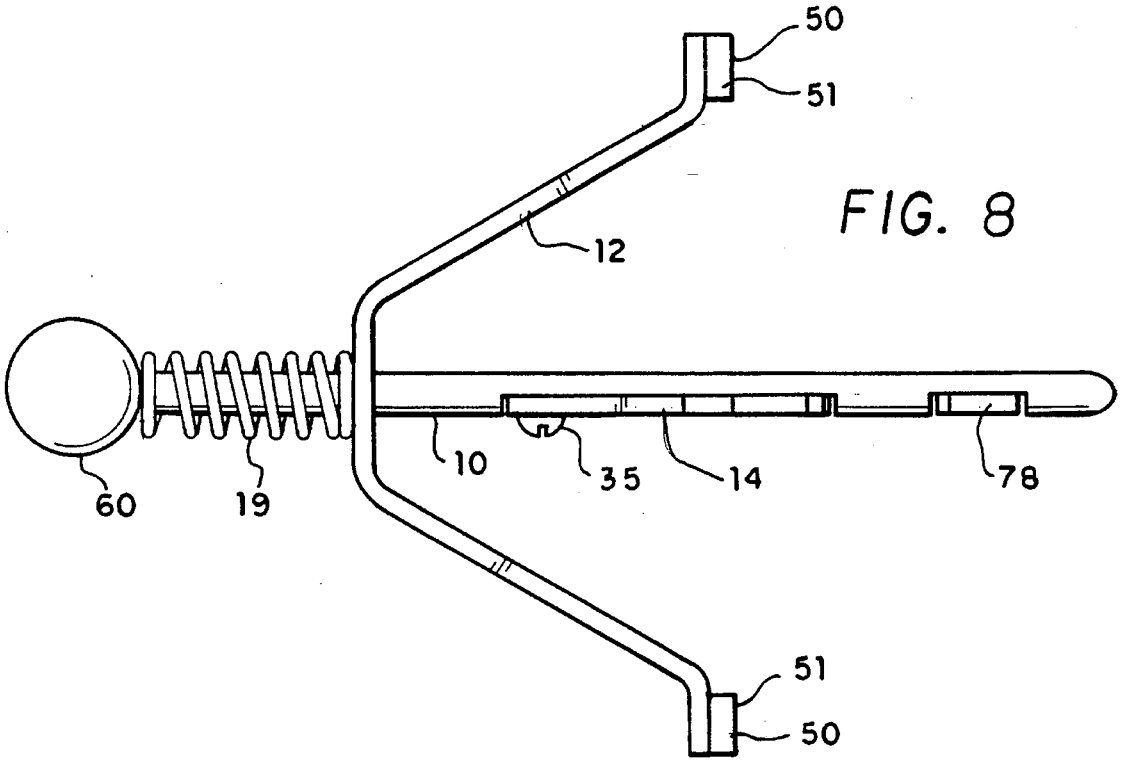
FIG. 8 is a top view of a fourth embodiment of the present invention.

FIG. 8 shows a fourth preferred embodiment of the self-releasing, similar in structure and operation to the first preferred embodiment described above, in which biasing means 16 includes a coil spring 19.

Figure 9:
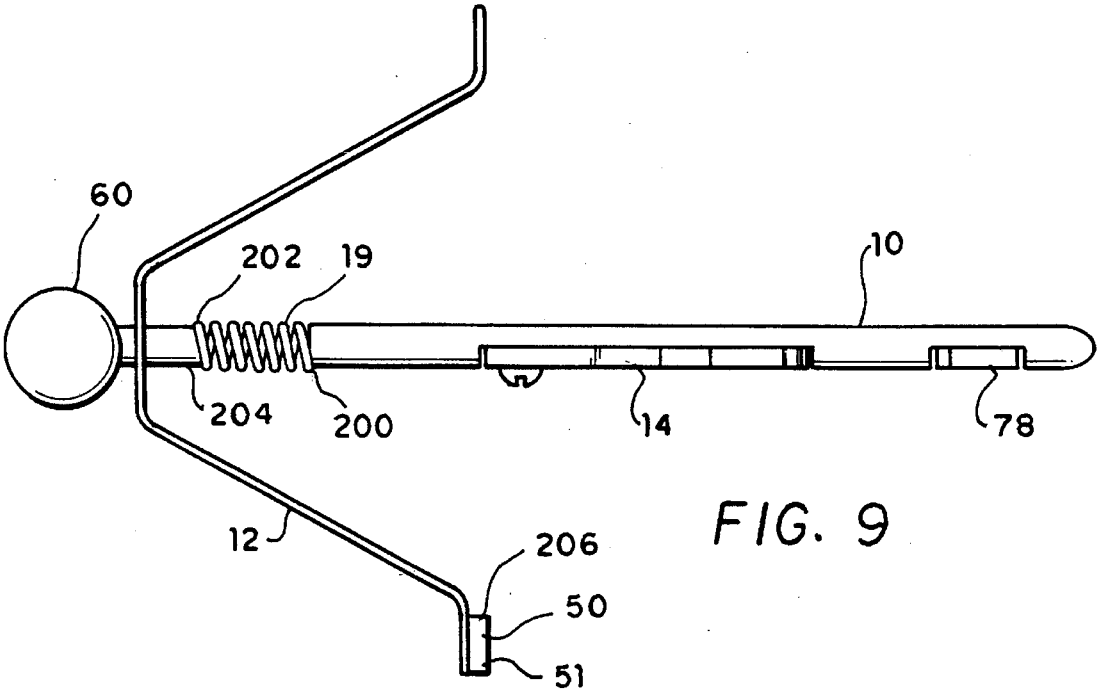
FIG. 9 is a top view of a fifth embodiment of the present invention.

A fifth preferred embodiment of the self-releasing pin is shown in FIG. 9. Coil spring 19 includes a first end 200 and a second end 202. First end 200 of coil spring 19 is attached to second end 22 of shaft 10. A cylindrical spring extension 204 is connected to second end 202 of coil spring 19. Cylindrical spring extension 204 is centrally mounted upon second face 42 of bracket 12. Bulbous handle 60 is centrally mounted upon first face 40 of bracket 12 in alignment with cylindrical spring extension 204. Supplemental attachment means 50 includes a single magnet 206.

The fifth preferred embodiment operates in substantially the same manner as described above. Bracket 12 is mounted upon a front face of selected weight 80. The weight lifter pushes shaft 10 into the inserted position as described above. Coil spring 19 is under tension between bracket 12 and shaft 10, biasing shaft 10 to the retracted position. The weight lifter reduces selected weight 80 to second weight 82 as described above in the operation of the first preferred embodiment. Once selected weight 80 is resting upon weight stack 70, coil spring 19 pulls shaft 10 out of channel 71 while magnet 206 holds bracket 12 onto the face of selected weight 80.

It should be noted that U-shaped rubber spring 18 and coil spring 19 can be interchangeably used with all the embodiments shown in FIGS. 1–8.

It is to be understood that the present invention is not limited to the sole embodiment described above, but encompasses any and all embodiments within the scope of the following claims.

I claim:

1. A self-releasing pin for a weight training machine of the type having a vertical stack of weights, said self-releasing pin comprising:

a shaft having first and second ends;

a bracket having first and second faces, said shaft being capable of reciprocating movement with respect to said bracket;

a retaining member pivotally attached to one of said bracket and said shaft; and a U-shaped rubber spring biasing means provided intermediate said second end and said bracket, said biasing means being fixed to said bracket and to said shaft proximate to said second end, whereby said self-releasing pin automatically releases a selected number of the vertical stack of weights from engagement with a lifting bar when the selected number of the vertical stack of weights is returned to a resting position.

2. The self-releasing pin according to claim 1, further comprising a bulbous handle mounted to said second end of said shaft, said handle being suitable for grasping by a user.

3. The self-releasing pin according to claim 1, further comprising a safety latch pivotally attached to said shaft, intermediate said first end and said bracket, for preventing said shaft from reciprocating movement with respect to said bracket.

4. The self-releasing pin according to claim 1, wherein said bracket includes an opening formed therein, said shaft passing through said opening, said first face being proximate said first end, said shaft being capable of reciprocating movement with respect to said bracket, and said biasing means being fixed to said second face and to said shaft proximate to said second end, whereby said biasing means is under compression when said shaft is inserted into a weight from the vertical stack of weights.

5. The self-releasing pin according to claim 4, wherein said shaft further includes a notch formed by a reduced diameter portion of said shaft, and said retaining member further includes a latch having first and second ends and an L-shaped unlocking member, said first end of said latch being pivotally connected to said bracket, said latch being capable of engaging said notch, thereby preventing reciprocating movement of said shaft through said opening, said L-shaped unlocking member pivotally connected to said second end of said latch and being capable of disengaging said latch from said notch when the vertical stack of weights is returned to a resting position.

6. The self-releasing pin according to claim 1, wherein said biasing means is fixed to said first face and to said shaft proximate to said second end whereby said biasing means is under tension when said shaft is inserted into a weight from the vertical stack of weights.

7. The self-releasing pin according to claim 1, wherein said retaining member further includes first and second ends, said first end of said retaining member being pivotally connected to said shaft, and said second end of said retaining member having a triangular-shaped extension for engagement with a retaining notch in a weight from the vertical stack of weights.

8. The self-releasing pin according to claim 1, wherein said retaining member further includes first and second ends, said first end of said retaining member being pivotally connected to said shaft, said second end of said retaining member having a magnet attached thereto for engagement with a weight from the vertical stack of weights.

9. The self-releasing pin according to claim 1, wherein said bracket includes supplemental attachment means mounted to said first face for assisting a user inserting said self-releasing pin in a weight of the vertical stack of weights.

10. The self-releasing pin according to claim 9, wherein said supplemental attachment means is a magnet.

11. The self-releasing pin according to claim 11, wherein said retaining member further includes first and second ends, said first end of said retaining member being pivotally connected to said shaft, and said second end of said retaining member having a triangular-shaped extension for engagement with a retaining notch in a weight from the vertical stack of weights.

12. A self-releasing pin for a weight training machine of the type having a vertical stack of weights, said self-releasing pin comprising:

a shaft having first and second ends;

a bracket having an opening therein, said shaft passing through said opening, said bracket having first and second faces, said first face being proximate said first end and having supplemental attachment means mounted thereon, said shaft being capable of reciprocating movement with respect to said bracket;

a retaining member pivotally attached to said shaft, said retaining member includes first and second ends, said first end of said retaining member being pivotally connected to said shaft, said second end of said retaining member having a magnet attached thereto for engagement with a weight from the vertical stack of weights;

a bulbous handle mounted to said second end of said shaft, said handle being suitable for grasping by a user;

a safety latch pivotally attached to said shaft, intermediate said first end and said bracket, for preventing said shaft from reciprocating through said opening; and biasing means provided intermediate said second end and said bracket, said biasing means being fixed to the second face of said bracket and to said shaft proximate to said second end, whereby said self-releasing pin automatically releases a selected number of the vertical stack of weights from engagement with a lifting bar when the selected number of the vertical stack of weights is returned to a resting position.

13. The self-releasing pin according to claim 12, wherein said supplemental attachment means is a magnet.

14. The self-releasing pin according to claim 12, wherein said biasing means is a spring.

15. A self-releasing pin for a weight training machine of the type having a vertical stack of weights, said self-releasing pin comprising:

a shaft having first and second ends and a notch formed by a reduced diameter portion of said shaft;

a bracket having an opening therein, said shaft passing through said opening, said bracket having first and second faces, said first face being proximate said first end and having supplemental attachment means mounted thereon, said shaft being capable of reciprocating movement with respect to said bracket;

a retaining member pivotally attached to said bracket, said retaining member including a latch having first and second ends and an L-shaped unlocking member, said first end of said latch being pivotally connected to said bracket, said latch being capable of engaging said notch thereby preventing reciprocating movement of said shaft through said opening, said L-shaped unlocking member pivotally connected to said second end of said latch and being capable of disengaging said latch from said notch when the vertical stack of weights is returned to a resting position;

a bulbous handle mounted to said second end of said shaft, said handle being suitable for grasping by a user;

a safety latch pivotally attached to said shaft, intermediate said first end and said bracket, for preventing said shaft from reciprocating through said opening; and biasing means provided intermediate said second end and said bracket, said biasing means being fixed to the second face of said bracket and to said shaft proximate to said second end, whereby said self-releasing pin automatically releases a selected number of the vertical stack of weights from engagement with a lifting bar when the selected number of the vertical stack of weights is returned to a resting position.

16. The self-releasing pin according to claim 15, wherein said supplemental attachment means is a magnet.

17. The self-releasing pin according to claim 16, wherein said biasing means is a spring.

* * * * *